United States Patent [19]

Root

[11] Patent Number: 4,834,258

[45] Date of Patent: May 30, 1989

[54] CAN CLOSURE

[76] Inventor: Charles E. Root, 7 Hidden Meadows, Milton, Vt. 05468

[21] Appl. No.: 105,563

[22] Filed: Oct. 8, 1987

[51] Int. Cl.[4] ..... B65D 17/34

[52] U.S. Cl. ..... 220/269; 220/270; 220/336

[58] Field of Search ..... 220/253, 258, 336, 269, 220/270; 222/480, 516, 548

[56] References Cited

U.S. PATENT DOCUMENTS 4,339,053 7/1982 Tarro ..... 220/336

4,717,039 1/1988 Ayyoubi ..... 220/336

*Primary Examiner*—George T. Hall

*Attorney, Agent, or Firm*—Jerry T. Kearns

[57] ABSTRACT

A closure for cans of the type utilized for packaging carbonated soft drinks and beer is in the form of a pivotal closure tab secured by a rivet on the top end of the can. The closure is specifically designed for use with can having a pull tab opener and is secured to the same rivet utilized to mount the opening pull tab. A leading end of the pivotal closure tab is provided with a flange which is bent downwardly and registers with a peripheral groove on the top surface of the can. By first open the can with the pull tab, the pivotal closure may be used to reclose the can to preserve the purity and carbonation of the contents.

4 Claims, 2 Drawing Sheets

FIG 1
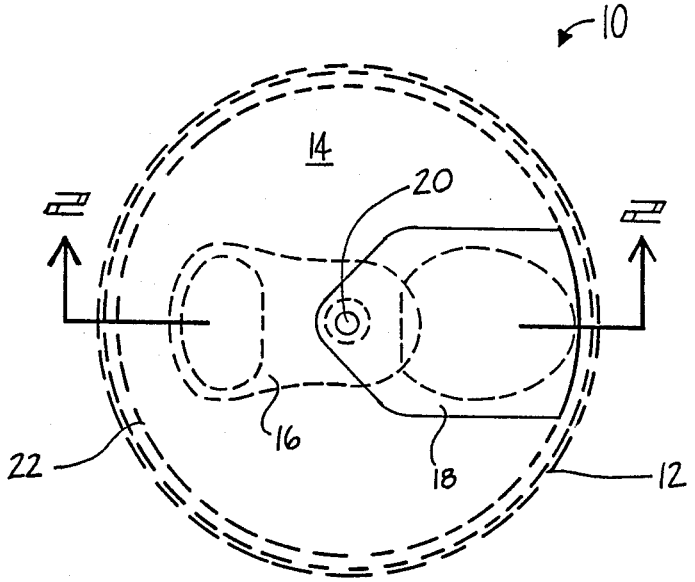
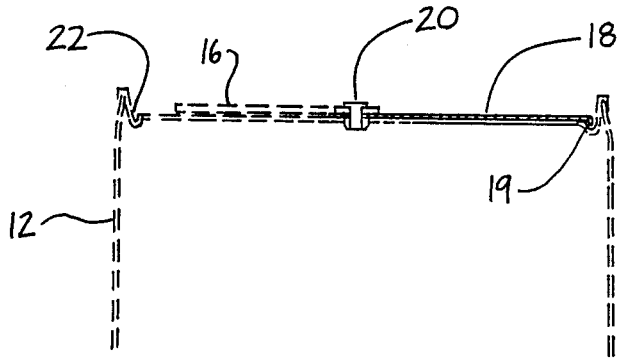
FIG 2

CAN CLOSURE

BACKGROUND OF THE INVENTION

1. Field of the Invention

The present invention relates to can closures, and more particularly pertains to a new and improved can closure specifically designed for use with cans of the type utilized to package carbonated sodas and beer. The widely used type of beverage can is provided with a pull tab opener for opening an aperture in the top surface of the can which has been previously weakened by score lines. In this conventional form of can, the aperture is opened by folding the weakened segment into the interior of the can. While this conventional type of beverage can provides an economical package which may be opened without use of any external tools, there is no convenient method of reclosing the aperture to preserve the purity and carbonation of the contents. At picnics and other outdoor functions, the usually sweetened contents of the can tend to attract bees and other insects. These insects may enter the interior of the can, thus polluting the contents. Also, when such a can is left unattended for a period of time after opening, the beverage loses its carbonation and becomes flat. To overcome these difficulties associated with the prior art beverage can, the present invention provides an integral pivotal closure tab which may be pivoted between open and closed positions, thus protecting the contents from contamination and loss of carbonation.

2. Description of the Prior Art

Various types of can closures are known in the prior art. A typical example of such a can closure is to be found in U.S. Pat. No. 2,218,042, which issued to G. Hutaff, Jr. on Oct. 15, 1940. This patent discloses a closure which may be opened by the use of a pull tab. However, no means to reclose the container after the initial opening is provided. U.S. Pat. No. 3,363,793, which issued to C. Simons on Jan. 16, 1968, discloses a closure for a container which utilizes a pull tab to open a metal closure by tearing at a previously formed score line. U.S. Pat. No. 3,416,687, which issued to F. Arnaud on Dec. 17, 1968, discloses a metal closure which is opened on a previously formed score line by use of riveted pull tab. U.S. Pat. No. 3,743,129, which issued to W. Willis et at on July 3, 1973, discloses a can with a tear off closure. A riveted pull tab is utilized to remove the closure along previously formed score lines. U.S. Pat. No. 4,318,493, which issued to R. Jacobsen et al on Mar. 9, 1982, discloses a closure of a thin walled metal container which includes a panel of thin sheet metal which extends over the open end of the container. A closure formed by score lines is torn away by use of a pull tab.

While the above mentioned devices are suited for their intended usage, none of these devices provide an integral pivotal closure on a pull tab type closure of a beverage can. Further, none of the aforesaid devices provide a beverage can with a riveted pivotal closure having a downwardly extending flange which cooperates with a peripheral groove on the top surface of a beverage can. Additionally, none of the prior art can closures utilizes a pivotal closure tab which may be economically provided on a conventional pull tab type beverage can. Inasmuch as the art is relatively crowded with respect to these various types of can closures, it can be appreciated that there is a continuing need for and interest in improvements to such can closures, and in this respect, the present invention addresses this need and interest.

SUMMARY OF THE INVENTION

In view of the foregoing disadvantages inherent in the known types of can closures now present in the prior art, the present invention provides an improved can closure. As such, the general purpose of the present invention, which will be described subsequently in greater detail, is to provide a new and improved can closure which has all the advantages of the prior art can closures and none of the disadvantages.

To attain this, representative embodiments of the concepts of the present invention are illustrated in the drawings and make use of pivotal closure tab which is connected by a rivet beneath a conventional pull tab closure of a beverage can. An additional feature of the present invention is the provision of a downwardly extending flange on the closure tab which cooperates with a peripheral groove formed on the top surface of the beverage can. By pivoting the closure tab between open and closed conditions after the initial opening of the can by the conventional pull tab, the contents of the can may be protected from contamination and from loss of carbonation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can closure which has all the advantages of the prior art can closures and none of the disadvantages.

It is another object of the present invention to provide a new and improved can closure which may be easily and efficiently manufactured and marketed.

It is a further object of the present invention to provide a new and improved can closure which is of a durable and reliable construction.

An even further object of the present invention is to provide a new and improved can closure which is susceptible of a low cost of manufacture with regard to both materials and labor, and which accordingly is then susceptible of low prices of sale to the consuming public, thereby making such can closures economically available to the buying public.

Still yet another object of the present invention is to provide a new and improved can closure which provides in the apparatuses and methods of the prior art some of the advantages thereof, while simultaneously overcoming some of the disadvantages normally associated therewith.

Still another object of the present invention is to provide a new and improved can closure which may be utilized with conventional pull tab beverage cans.

Yet another object of the present invention is to provide a new and improved can closure which utilizes a pivotal closure tab attached to the pull tab mounting rivet of a conventional beverage can.

Even still another object of the present invention is to provide a new and improved can closure for use with a conventional pull tab type beverage can which may be selectively pivoted between open and closed positions to protect the contents of the can from contamination and loss of carbonation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top plan view of a beverage can provided with the pivotal closure tab of the present invention.

FIG. 2 is a cross sectional view taken along line 2—2 of FIG. 1, illustrating the pivotal mounting of the closure tab.

DESCRIPTION OF THE PREFERRED EMBODIMENT

Figure 3:
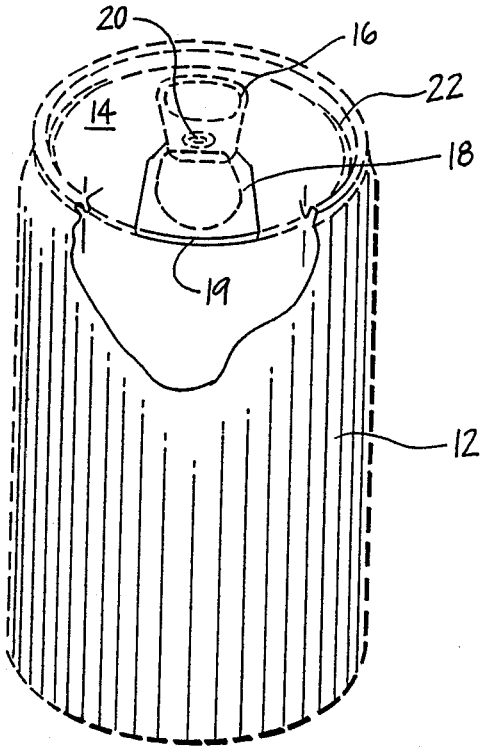
FIG. 3 is perspective view of a beverage can provided with the pivotal closure tab of the present invention and illustrating the downwardly extending flange thereof.

With reference now to the drawings, and in particular to FIG. 1 thereof, a new and improved can closure embodying the principles and concepts of the present invention and generally designated by the reference numeral 10 will be described.

More specifically, it will be noted that the first embodiment 10 of the invention includes a conventional beverage can 12 which may be constructed from aluminum in a conventional deep drawing operation. The can 12 has a top surface 14 on which a pull tab opener 16 is fastened by means of a rivet 20. A pivotal closure tab is mounted on the same rivet 20, beneath the pull tab 16. A peripheral groove 22 is formed on the top surface 14 of the can 12.

As shown in FIG. 2, a leading edge of the pivotal closure tab 18 is provided with a downwardly extending flange 19 which registers with the groove 22 provided in the top surface 14 of the can 12. As shown, the pivotal closure 18 is mounted by a rivet 20 extending through an aperture formed at a rear end of the pivotal closure tab 18. The same rivet 20 is utilized to secure the conventional pull tab 16 on top of the pivotal closure tab 18. It should be noted that the leading edge of the closure tab 18 and the downwardly extending flange 19 are provided with a radius to facilitate engagement with the groove 22. The opposite end of the pivotal closure tab 18 is tapered to form a radiused apex. This configuration insures freedom from interference with the pull tab opener 16.

As shown in FIG. 3, after the pull tab opener 16 has ben utilized to open the can 12 in a conventional manner, the pivotal closure tab 18 may be pivoted to a closed position to cover the aperture in the top surface 14 of the can 12. A secure sealing of the aperture is provided by virtue of a downward flexure of the pivotal closure tab 18, thus pressing the tab 18 into engagement with the top surface 14 of the can 12. The downwardly extending flange 19 further serves to retain the pivotal closure tab 18 in the selected position. The flange 19 also prevents the tab 18 from being inadvertently pulled upwardly away from the top surface 14 of the can 12.

With reference now to FIG. 3, the manner of usage of the pivotal closure tab 18 of the present invention will now be described. Initially, the closure tab 18 is pivoted to a position located one hundred and eighty degrees from the position it occupies in FIG. 3. The conventional pull tab opener 16 is then lifted to bend a section of the top surface 14 of the can 12 downwardly along previously formed score lines, thus forming an aperture in the top surface 14 of the can 12. A desired quantity of the contents may be drunk or poured from the can 12, and if it is now desired to close the interior of the can 12 to protect the contents from contamination or loss of carbonation, the pivotal closure tab 18 is pivoted to the position illustrated in FIG. 3.

It is contemplated that the closure tab 18 will be formed from aluminum and assembled in the illustrated position during the original manufacture of the can.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In a cylindrical beverage can having a circular top surface with a circular peripheral groove, score lines on the top surface defining an intended opening, a pull tab opener mounted by a rivet on the top surface adjacent the intended opening, the improvement comprising:

a pivotal closure tab mounted on the top surface of the can by the rivet for movement about the rivet independently of the pull tab opener for selectively opening and closing the can after initial opening by the pull tab opener; and said closure tab having an arcuate leading edge with an arcuate downwardly extending flange in registry with the circular peripheral groove on the can top surface.

2. The can closure of claim 1, wherein said pivotal closure tab has an end adjacent the rivet which tapers to a radiused apex.

3. The can closure of claim 1, wherein said pivotal closure tab is mounted on the rivet between the pull tab opener and the top surface of the can.

4. The can closure of claim 1, wherein said pivotal closure tab comprises a thin flat aluminum tab.

* * * * *